US011299685B2

(12) United States Patent
Russo

(10) Patent No.: US 11,299,685 B2
(45) Date of Patent: Apr. 12, 2022

(54) FUEL AND ENGINE OIL COMPOSITION AND ITS USE

(75) Inventor: Joseph Michael Russo, Katy, TX (US)

(73) Assignee: SHELL OIL COMPANY, Houston, TX (US)

( * ) Notice: Subject to any disclaimer, the term of this patent is extended or adjusted under 35 U.S.C. 154(b) by 1952 days.

(21) Appl. No.: 12/858,270

(22) Filed: Aug. 17, 2010

(65) Prior Publication Data

US 2011/0065619 A1 Mar. 17, 2011

Related U.S. Application Data

(60) Provisional application No. 61/234,689, filed on Aug. 18, 2009.

(51) Int. Cl.

| | |
|---|---|
| ***C10M 133/08*** | (2006.01) |
| ***C10L 1/2387*** | (2006.01) |
| ***C10L 1/222*** | (2006.01) |
| ***C10L 10/08*** | (2006.01) |
| *C10N 30/02* | (2006.01) |
| *C10N 30/06* | (2006.01) |
| *C10N 30/00* | (2006.01) |
| *C10N 40/25* | (2006.01) |

(52) U.S. Cl.

CPC ..... *C10L 1/2387* (2013.01); *C10L 1/2225* (2013.01); *C10L 10/08* (2013.01); *C10M 133/08* (2013.01); *C10N 2030/02* (2013.01); *C10N 2030/06* (2013.01); *C10N 2030/56* (2020.05); *C10N 2030/66* (2020.05); *C10N 2040/25* (2013.01)

(58) Field of Classification Search

CPC ..... C10L 1/2387; C10L 1/2225; C10L 10/08; C10M 133/08; C10N 2030/02; C10N 2030/06; C10N 2030/56; C10N 2030/66; C10N 2040/25

USPC ..... 508/561

See application file for complete search history.

(56) References Cited

U.S. PATENT DOCUMENTS

| | | | | |
|---|---|---|---|---|
| 6,224,642 | B1 | 5/2001 | Daly et al. | 44/434 |
| 6,245,719 | B1 | 6/2001 | Kobori | |
| 7,435,272 | B2 | 10/2008 | Aradi et al. | 44/408 |
| 9,919,074 | B2 | 3/2018 | Wellisz et al. | |
| 2005/0215441 | A1* | 9/2005 | Mackney et al. | 508/291 |
| 2009/0286684 | A1 | 11/2009 | Scherl et al. | |

FOREIGN PATENT DOCUMENTS

| | | | |
|---|---|---|---|
| EP | 0869163 | 10/1998 | C10L 1/22 |
| EP | 1357170 | 10/2003 | C10L 1/22 |
| JP | H10176175 A | 6/1998 | |
| JP | 2003193070 A | 7/2003 | |
| WO | 03083020 A2 | 10/2003 | |

* cited by examiner

*Primary Examiner* — Taiwo Oladapo

(74) *Attorney, Agent, or Firm* — Shell Oil Company

(57) ABSTRACT

A composition is provided that contains a major amount of a base oil and a minor amount of at least one butylene oxide-modified alkyl-bis-ethoxylated monoamine, wherein the alkyl group have carbon atoms in the range of 8 to 22 and ethylene oxide to butylenes oxide is in a ratio in the range of about 3:1 to about 2:1. The composition provides improved friction modification in fuel and in lubricating oils.

8 Claims, 6 Drawing Sheets

FUEL AND ENGINE OIL COMPOSITION AND ITS USE

The present application claims the benefit of pending U.S. Provisional Patent Application Ser. No. 61/234,689 filed Aug. 18, 2009, the entire disclosure of which is hereby incorporated by reference.

FIELD OF THE INVENTION

The present invention relates to fuel and engine oil compositions and their use, particularly, in combustion engines.

BACKGROUND OF THE INVENTION

Engine manufactures in developed countries are continuously challenged to improve the fuel economy of vehicles in the market place. The original equipment manufacturers for vehicles are being pressured to meet and exceed the Environmental Protection Agency's Corporate Average Fuel Economy (CAFE) requirements as well to reduce the vehicles fuel consumption which in turn would reduce the dependency on imported oil. Fuel economy is defined as the average mileage traveled by an automobile per gallon of gasoline (or equivalent amount of other fuel) consumed as measured in accordance with the testing and evaluation protocol set forth by the Environmental Protection Agency (EPA).

A vehicle fuel economy improvement can be accomplished in many ways. However, it is believed that one major area is friction. Engine friction can be separated into six areas with each area contributing to a certain amount of frictional attribute. The approximate area of contribution to engine friction are: 6.0% valve train, 25% piston, 19% rings, 10% con rod bearings, 12.5% main bearings, 27.5% pump loss.

Friction modifier such as isohexyloxyproplyamine isostearate or cyclic saturated carboxylic acid salts of an alkoxylated amine or ether amines, which are reported in U.S. Pat. No. 7,435,272, are currently used as friction modifiers in fuel. However, to meet the requirements of ever demanding fuel economy vehicle, it is desirable to provide fuels and motor oils with more efficient friction modification.

SUMMARY OF THE INVENTION

In accordance with certain of its aspects, in one embodiment of the present invention provides a composition comprising: (a) a major amount of a base oil and (b) a minor amount of at least one butylene oxide-modified alkyl-bis-ethoxylated monoamine, wherein the alkyl group have carbon atoms in the range of 16 to 18 and ethylene oxide to butylenes oxide is in a ratio in the range of about 3:1 to about 2:1.

In another embodiment, the present invention provides a fuel composition comprising (a) a major amount of a mixture of hydrocarbons in the gasoline boiling range and (b) a minor amount of at least one butylene oxide-modified alkyl-bis-ethoxylated monoamine, wherein the alkyl group have carbon atoms in the range of 16 to 18 and ethylene oxide to butylenes oxide is in a ratio in the range of about 3:1 to about 2:1.

In another embodiment, the present invention provides a lubricating oil composition comprising (a) a major amount of mineral and/or synthetic base oil and (b) a minor amount of at least one butylene oxide-modified alkyl-bis-ethoxylated monoamine, wherein the alkyl group have carbon atoms in the range of 16 to 18 and ethylene oxide to butylenes oxide is in a ratio in the range of about 3:1 to about 2:1.

Yet in another embodiment, the present invention provides a method for reducing friction coefficient in an internal combustion engine which comprises burning in said engine a fuel composition described above.

DETAILED DESCRIPTION OF THE INVENTION

Figure 1:
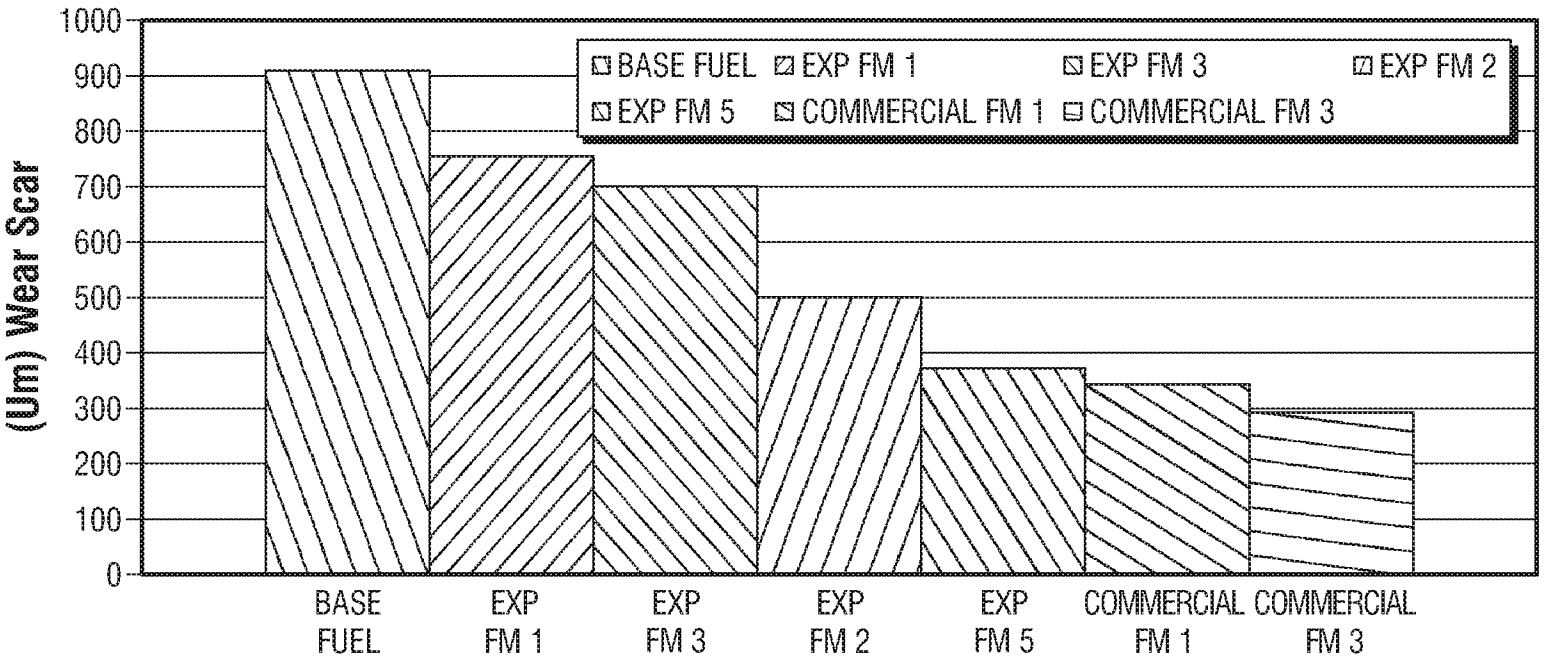
FIG. 1—This figure represents high frequency reciprocating rig (HFRR) generating wear values of fuel containing the experimental and commercial friction modifiers from the Examples.

We have found that a composition comprising: (a) a major amount of a base oil and (b) a minor amount of at least one butylene oxide-modified alkyl-bis-ethoxylated monoamine, wherein the alkyl group have carbon atoms in the range of 16 to 18 and ethylene oxide to butylenes oxide is in a ratio in the range of about 3:1 to about 2:1 provide excellent boundary friction value while being not too emulsifiable.

A friction modifier works by absorbing its polar end toward the metal surface allowing the two moving metal surfaces to slide over each other easily. Therefore if a friction modifier is able to emulsify with water, which may come in contact with the fuel, the friction modifier becomes and emulsifier may not be attached to the metal surface. In addition if a friction modifier is capable of emulsifying with water and is formulated into a fuel additive package; the emulsifier which is part of the fuel additive package may need to be increased to compensate for the added emulsibility of the friction modifier because any water which maybe dispersed in the fuel could cause engine problems such as stalling, hesitation or complete engine failure. Therefore it would be advantageous to develop a friction modifier which is able to reduce friction but also able to not emulsify with water and in fact separate the water from the fuel. We have found that certain butylene oxide-modified alkyl-bis ethoxylated monoamine can provide excellent friction modification even for used motor oil while also providing good dehazing property.

The butylene oxide-modified alkyl-bis ethoxylated monoamine can be prepared by various ways known to one skill in the art. In one method, the friction modifier can be prepared by reacting about one mole of an alky amine with between about 2 to about 3 moles of ethylene oxide at a temperature within the range form about 80° C. to about 200° C. Then, about 1 mole of butylene oxide is allowed to react to the ethylene oxide reacted alkyl amine. The friction modifier preferably include compounds having the general formula:

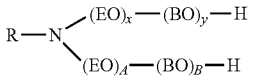

(Formula I)

wherein EO is ethylene oxide moiety and BO is butylene oxide moiety, R is an alkyl group having 8 to 22 carbon atoms, preferably 12 to 18 carbon atoms, A is an integer from 1 to 5, B is an integer from 1 to 5, X is an integer from 0 to 5 and Y is an integer from 0 to 5. These butylenes oxide-modified alky-bis ethoxylated monoamine are available from Huntsman Corporation and Akzo Nobel. Other synthetic routes known in the art can be used in the preparation of the butylene oxide-modified alkyl-bis ethoxylated monoamines useful in the invention. In one embodiment, the butylene oxide-modified alkyl-bis ethoxylated monoamine contains both a terminal ethylene oxide moiety and a butylene oxide moiety.

Suitable liquid hydrocarbon fuels of the gasoline boiling range are mixtures of hydrocarbons having a boiling range of from about 25° C. to about 232° C. and comprise mixtures of saturated hydrocarbons, olefinic hydrocarbons and aromatic hydrocarbons. Preferred are gasoline mixtures having a saturated hydrocarbon content ranging from about 40% to about 80% by volume, an olefinic hydrocarbon content from 0% to about 30% by volume and an aromatic hydrocarbon content from about 10% to about 60% by volume. The base fuel is derived from straight run gasoline, polymer gasoline, natural gasoline, dimer and trimerized olefins, synthetically produced aromatic hydrocarbon mixtures, or from catalytically cracked or thermally cracked petroleum stocks, and mixtures of these. The hydrocarbon composition and octane level of the base fuel are not critical. The octane level, (R+M)/2, will generally be above about 85. Any conventional motor fuel base can be employed in the practice of the present invention. For example, hydrocarbons in the gasoline can be replaced by up to a substantial amount of conventional alcohols or ethers, conventionally known for use in fuels. The base fuels are desirably substantially free of water since water could impede a smooth combustion.

Normally, the hydrocarbon fuel mixtures to which the invention is applied are substantially lead-free, but may contain minor amounts of blending agents such as methanol, ethanol, ethyl tertiary butyl ether, methyl tertiary butyl ether, tert-amyl methyl ether and the like, at from about 0.1% by volume to about 15% by volume of the base fuel, although larger amounts may be utilized. The fuels can also contain conventional additives including antioxidants such as phenolics, e.g., 2,6-di-tertbutylphenol or phenylenediamines, e.g., N,N'-di-sec-butyl-p-phenylenediamine, dyes, metal deactivators, dehazers such as polyester-type ethoxylated alkylphenol-formaldehyde resins. Corrosion inhibitors, such as a polyhydric alcohol ester of a succinic acid derivative having on at least one of its alpha-carbon atoms an unsubstantiated or substituted aliphatic hydrocarbon group having from 20 to 50 carbon atoms, for example, pentaerythritol diester of polyisobutylene-substituted succinic acid, the polyisobutylene group having an average molecular weight of about 950, in an amount from about 1 ppm (parts per million) by weight to about 1000 ppm by weight, may also be present.

An effective amount of one or more compounds of Formula I are introduced into the combustion zone of the engine in a variety of ways to reduce the friction between the piston ring and the cylinder wall. As mentioned, a preferred method is to add a minor amount of one or more compounds of Formula I to the fuel. For example, one or more compounds of Formula I may be added directly to the fuel or blended with one or more carriers and/or one or more additional detergents to form an additive concentrate which may then be added at a later date to the fuel.

Generally, each compound of Formula I is added in an amount up to about 10% by weight, especially from about 0.5% by weight, more preferably from about 1% by weight, even more preferably from about 2% by weight, to preferably about 8% by weight, more preferably to about 6% by weight, even more preferably to about 4% by weight based on the total weight of the fuel composition.

The fuel compositions of the present invention may also contain one or more additional detergents. When additional detergents are utilized, the fuel composition will comprise a mixture of a major amount of hydrocarbons in the gasoline boiling range as described hereinbefore, a minor amount of one or more compounds of Formula I as described hereinbefore and a minor amount of one or more additional detergents. As noted above, a carrier as described hereinbefore may also be included. As used herein, the term "minor amount" means less than about 10% by weight of the total fuel composition, preferably less than about 1% by weight of the total fuel composition and more preferably less than about 0.1% by weight of the total fuel composition. However, the term "minor amount" will contain at least some amount, preferably at least 0.001%, more preferably at least 0.01% by weight of the total fuel composition.

The one or more additional detergents are added directly to the hydrocarbons, blended with one or more carriers, blended with one or more compounds of Formula I, or blended with one or more compounds of Formula I and one or more carriers before being added to the hydrocarbon. The compounds of Formula I can be added at the refinery, at a terminal, at retail, or by the consumer.

The treat rate of the fuel additive detergent packages that contains one or more additional detergents in the final fuel composition is generally in the range of from about 0.007 weight percent to about 0.76 weight percent based on the final fuel composition. The fuel additive detergent package may contain one or more detergents, dehazer, corrosion inhibitor and solvent. In addition a carrier fluidizer may sometimes be added to help in preventing intake valve sticking at low temperature.

The base oil used in the lubricating oil compositions in the present invention may comprise any mineral oil, any synthetic oil or mixtures thereof.

Base oils of mineral origin may include those produced by solvent refining or hydro processing.

Mineral oils that may be conveniently used include paraffinic oils or naphthenic oils or normal paraffins, for example, those produced by refining lubricating oil cuts obtained by low-pressure distillation of atmospheric residual oils, which were in turn obtained, by atmospheric distillation of crude oil.

Examples of mineral oils that may conveniently be used include those sold by member companies of the Royal Dutch/Shell Group under the designations "HVI", "MVIN", or "HMVIP".

Specific examples of synthetic oils that may be conveniently used include polyolefin's such as poly-α-olefins, co-oligomers of ethylene and α-olefins and polybutenes, poly(alkylene glycol)s such as poly(ethylene glycol) and poly(propylene glycol), diesters such as di-2-ethylhexyl sebacate and di-2-ethylhexyl adipate, polyol esters such as trimethylolpropane esters and pentaerythritol esters, perfluoroalkyl ethers, silicone oils and polyphenyl ethers. Such synthetic oils may be conveniently used as single oils or as mixed oils.

Base oils of the type manufactured by the hydroisomerisation of wax, such as those sold by member companies of the Royal Dutch/Shell Group under the designation "XHVI" (trade mark), may also be used.

The lubricant oils may also contain a number of conventional additives in amounts required to provide various functions. These additives include, but are not limited to, ashless dispersants, metal or overbased metal detergent additives, anti-wear additives, viscosity index improvers, antioxidants, rust inhibitors, pour point depressants, friction reducing additives, and the like.

Suitable ashless dispersants may include, but are not limited to, polyalkenyl or borated polyalkenyl succinimide where the alkenyl group is derived from a $C_3$-$C_4$ olefin, especially polyisobutenyl having a number average molecular weight of about 5,000 to 7,090. Other well known dispersants include the oil soluble polyol esters of hydrocarbon substituted succinic anhydride, e.g. polyisobutenyl succinic anhydride, and the oil soluble oxazoline and lactone oxazoline dispersants derived from hydrocarbon substituted succinic anhydride and di-substituted amino alcohols. Lubricating oils typically contain about 0.5 to about 5 wt % of ashless dispersant.

Suitable metal detergent additives are known in the art and may include one or more of overbased oil-soluble calcium, magnesium and barium phenates, sulfurized phenates, and sulfonates (especially the sulfonates of $C_{16}$-$C_{50}$ alkyl substituted benzene or toluene sulfonic acids which have a total base number of about 80 to 300). These overbased materials may be used as the sole metal detergent additive or in combination with the same additives in the neutral form; but the overall metal detergent additive should have a basicity as represented by the foregoing total base number. Preferably they are present in amounts of from about 3 to 6 wt % with a mixture of overbased magnesium sulfurized phenate and neutral calcium sulfurized phenate (obtained from $C_9$ or $C_{12}$ alkyl phenols).

Suitable anti-wear additives include, but are not limited to, oil-soluble zinc dihydrocarbyldithiophosphates with a total of at least 5 carbon atoms and are typically used in amounts of about 1-6% by weight.

Suitable viscosity index improvers, or viscosity modifiers, include, but are not limited to olefin polymers, such as polybutene, hydrogenated polymers and copolymers and terpolymers of styrene with isoprene and/or butadiene, polymers of alkyl acrylates or alkyl methacrylates, copolymers of alkyl methacrylates with N-vinyl pyrrolidone or dimethylaminoalkyl methacrylate, post-grafted polymers of ethylene and propylene with an active monomer such as maleic anhydride which may be further reacted with alcohol or an alkylene polyamine, styrene-maleic anhydride polymers post-reacted with alcohols and amines and the like. These are used as required to provide the viscosity range desired in the finished oil in accordance with known formulating techniques.

Examples of suitable oxidation inhibitors include, but are not limited to hindered phenols, such as 2,6-di-tertiarybutylparacresol, amines sulfurized phenols and alkyl phenothiazones. Usually, lubricating oil may contain about 0.01 to 3 wt % of oxidation inhibitor, depending on its effectiveness. For improved oxidation resistance and odor control, it has been observed that up to about 5 wt % of an antioxidant should be included in the aforementioned formula. One suitable example of such, butylated hydroxytoluene ("BHT"), or di-t-butyl-p-cresol, is sold by many supplies including Rhein Chemie and PMX Specialties. Another suitable example is Irganox L-64 from Ciba Giegy Corp.

Rust inhibitors may be employed in very small proportions such as about 0.1 to 1 weight percent with suitable rust inhibitors being exemplified by $C_9$-$C_{30}$ aliphatic succinic acids or anhydrides such as dodecenyl succinic anhydride. Antifoam agents are typically included, but not limited to polysiloxane silicone polymers present in amounts of about 0.01 to 1 wt %.

Pour point depressants are used generally in amounts of from about 0.01 to about 10.0 wt %, more typically from about 0.1 to about 1 wt %, for most mineral oil base stocks of lubricating viscosity. Illustrative of pour point depressants which are normally used in lubricating oil compositions include, but are not limited to, polymers and copolymers of n-alkyl methacrylate and n-alkyl acrylates, copolymers of di-n-alkyl fumarate and vinyl acetate, alpha-olefin copolymers, alkylated naphthalenes, copolymers or terpolymers of alpha-olefins and styrene and/or alkyl styrene, styrene dialkyl maleic copolymers and the like.

As discussed in U.S. Pat. No. 6,245,719, which is fully incorporated by reference herein, a variety of additives may be used to improve oxidation stability and serviceability of lubricants used in automotive, aviation, and industrial applications. These additives include calcium phenate, magnesium sulfonate and alkenyl succinimide to agglomerate solid impurities, a combination of an ashless dispersant, metallic detergent and the like, an oxidation inhibitor of sulfur-containing phenol derivative or the like, an oxidation inhibitor or the like, or mixtures thereof.

While the invention is susceptible to various modifications and alternative forms, specific embodiments thereof are shown by way of examples herein described in detail. It should be understood, that the detailed description thereto are not intended to limit the invention to the particular form disclosed, but on the contrary, the intention is to cover all modifications, equivalents and alternatives falling within the spirit and scope of the present invention as defined by the appended claims. The present invention will be illustrated by the following illustrative embodiment, which is provided for illustration only and is not to be construed as limiting the claimed invention in any way.

Test Methods

| HFRR Conditions | |
|---|---|
| Fluid volume | 15 ml +/− 0.2 ml |
| Fluid temperature | 25° C. +/− 1° C. |
| Bath surface area | 6.0 cm2 +/− 1 cm2 |

-continued

| HFRR Conditions | |
|---|---|
| Stroke length | 1.0 mm +/− 0.02 mm |
| Frequency | 50 Hz +/− 1 |
| Applied Load | 200 g +/− 1 g |
| Test duration | 75 mins +/− 0.1 min |
| Specimen | steel AISI E-52100 |
| Ball diameter | 6 mm |
| Surface finish (ball) | <0.05 um Ra |
| Hardness (ball) | 58-66 Rockwell |
| Surface finish | <0.02 um Ra |
| Hardness (plate) | 190-210 Hv 30 |

Cameron—Plint

Boundary friction coefficient measurements were obtained using a Plint TE/77 High Frequency Friction Machine. A pin-on-plate test configuration was used; the test plate was an annealed ground gage cold worked tool steel plate (AISI-01; maximum hardness of 20 on the Rockwell C scale), and the pin (16×6 mm, high carbon steel) and was held in position on a moving arm against the stationary plate. Load was applied through a bearing arrangement to the top of the reciprocating head. Plate specimens were surface ground to a Ra roughness of 0.35-0.45 μm. (Plates were surface ground in the direction of motion.) No cutting fluids were used in specimen preparation.

In the test method, a new test plate was placed in the specimen holder on the Cameron Plint Friction Machine, and the dowel pin was placed in the movable arm. Twenty (20) ml of the test oil was placed in the sample boat. The arm was then placed on the plate and the load yoke was put in place over the movable arm and the computer test sequence was started. The steel pin was moved in an oscillating motion over a 15 mm path on the steel plate at a frequency of 15 Hz. A running-in procedure was established consisting of (a) a 15 minute break-in at 100° C., 50N load and 15 Hz, (b) a 15 minute isothermal run at 100N and 15 Hz, (c) a temperature ramp to 150° C., and (d) a 15 minute isothermal run at 150° C. (100N load, 15 Hz). Friction coefficient values were averaged over the 15 minute isothermal runs for each temperature.

TABLE I

| TE-77 Pin-on-Plate Test Parameters | |
|---|---|
| Geometry | Pin-on-Plate |
| Plate Specimen | Annealed ground gage cold worked tool steel plate |
| Plate roughness | Ra 0.35-0.45 μm (ground parallel to direction of motion) |
| Pin | 16 × 6 high carbon steel |
| Contact pressure | 252 MPa (nominal) |
| Temperature | 100-150° C. |
| Frequency | 15 Hz |
| Duration | 15 minutes |

ASTM D1094

The ASTM D-1094 test method covers the determination of the presence of water-miscible components in aviation gasoline and turbine fuels, and the effect of these components on volume change and on the fuel-water interface.

A sample of the fuel is shaken, using a standardized technique, at room temperature with a phosphate buffer solution in scrupulously cleaned glassware. The cleanliness of the glass cylinder is tested. The change in volume of the aqueous layer and the appearance of the interface are taken as the water reaction of the fuel.

Mini-Traction Machine (MTM)

The Mini Traction Machine (MTM) is a ball on disc lubricant bench test, which measures the friction modifiers ability to reduce friction under boundary, transitional (mixed), and elastohydrodynamic conditions. The MTM is a computer controlled precision traction measurement system. The unit uses two DC motors to independently drive the ball and disc. A wide variety of profiles (test methods) can be set up for different applications. The conditions used for the friction modifiers runs twenty successive Stribeck curves from 3000 to 20 mm/second under a 20 N load at a temperature of 140° C.

5W30 GF4 Motor Oil

A 5W30 GF4 motor oil meeting the following lubricant criteria was used.

Those values can be seen below:

| | |
|---|---|
| −30° C. cold cranking value: | max 6600 cP |
| −35° C. low temperature pumping: | max 60,000 cP |

The 30 values represents the 100° C. low shear and 150° C. high shear of the lubricant.

Those values can be seen below:

| | |
|---|---|
| 100° C. low shear: | 9.3-12.5 cST |
| 150° C. high shear: | 2.9 cP min |

GF-4 is the energy conserving classification from API. The API GF-4 classification can be obtained from American Petroleum Institute.

Base Fuel

The base fuel used in the test was an 87 R+M/2 regular base fuel. The base fuel physical properties can be found in Table II.

TABLE II

| Base Fuel Physical Properties | |
|---|---|
| API Gravity | 61.9 |
| RVP | 13.45 |
| Distillation, (° F.) | |
| IBP | 87.1 |
| 10% | 107.3 |
| 20% | 123.2 |
| 30% | 141.0 |
| 40% | 161.5 |
| 50% | 185.9 |
| 60% | 218.1 |
| 70% | 260.2 |
| 80% | 308.6 |
| 90% | 349.0 |
| 95% | 379.3 |
| End Pt. | 434.7 |
| % Recovered | 97.2 |
| % Residue | 1.1 |
| % Loss | 1.7 |
| FIA (vol %) | |
| Aromatic | 28 |
| Olefins | 12.7 |
| Saturates | 59.3 |
| Gum (mg/100 ml) | |
| Unwashed | 3 |
| MON | 81.9 |
| RON | 92 |

TABLE II-continued

| Base Fuel Physical Properties | |
|---|---|
| R + M/2 | 87 |
| Oxygenates | None |

EXAMPLES

Examples were prepared using experimental friction modifiers Exp FM1, Exp FM2, Exp FM3, Exp FM4, Exp FM5, respectively. Comparative Examples 3 were prepared using commercially available friction modifiers Commercial FM1, Commercial FM2, Commercial FM 3, respectively.

| Friction Modifiers | |
|---|---|
| Name | Structure |
| Exp FM 1 | $C_{16}$-$C_{18}$—$N(EO)_4(BO)_8$—$(H)_2$ |
| Exp FM 2 | $C_{16}$-$C_{18}$—$N(EO)_4(BO)_4$—$(H)_2$ |
| Exp. FM 3 | $C_{16}$-$C_{18}$—$N(EO)_8(BO)_2$—$(H)_2$ |
| Exp. FM 4 | $C_{16}$-$C_{18}$—$N(EO)_3(BO)_1$—$(H)_2$ |
| Exp. FM 5 | $C_{16}$-$C_{18}$—$N(EO)_2(BO)_1$—$(H)_2$ |
| Commerical FM 1 | $C_{16}$-$C_{18}$—$N(EO)_2$—$(H)_2$ |
| Commerical FM 2 | Oleyl ethoxylated amide |
| Commerical FM 3 | Stearyl ethoxylated amide |

The above Friction Modifiers (Exp FM1 to FM5) were obtained from Huntsman Chemical Corporation. The commercial friction modifiers were purchased from commercial sources.

The experimental and commercial friction modifiers were added to 100 ml of 87-octane base fuel at 0.15 wt % according to Table III. The individual samples were submitted for HFRR wear scar testing. Graph I in FIG. 1 detail the HFRR wear scar results.

TABLE III

HFRR Wear Scar Results concerning 0.15 WT % Friction Modifiers added to 87 Octane Base Fuel

| Example # | Friction Modifier Description | Additive Amount (wt %) |
|---|---|---|
| Exp FM 1 | 1 part alky amine/4 parts of ethylene oxide/8 parts of butylene oxide | 1 |
| Exp FM 2 | 1 part Alkyl amine/4 parts of ethylene oxide/4 parts of butylene oxide | 1 |
| Exp FM 3 | 1 part Alkyl amine/8 parts of ethylene oxide/2 parts of butylene oxide | 1 |
| Exp FM 5 | 1 part Alkyl amine/2 parts of ethylene oxide/1 part of butylene oxide | 1 |
| Commerical FM 1 | 1 part Alkyl amine/2 parts of ethylene oxide | 1 |
| Commerical FM 3 | 1 part Stearyl amide/2 parts of ethylene oxide | 1 |

FIG. 1 (0.15 Wt % Friction Modifier 87 Octane Base Fuel HFRR Wear Scar Results) detail the experimental and commercial friction modifiers responses at reducing the HFRR wear scar concerning the base fuel. Structural reponses to reducing the base fuel wear scar can be extracted from the FIG. 1 data. Higher content of either butylene oxide or ethylene oxide tend to have a small affect at reducing the base fuel wear scar. However when the butylene oxide and ethylene oxide is reduced such as exp 5 at which butylene oxide is 1 part and ethylene oxide is 2 parts, maximum reduction in scar is observed and equivalent to the reduction in which is obtained from either of the two commercial friction modifiers.

Examples 1-4 and Comparative Examples 1-12

All friction modifiers outlined in Table IV were added to 100 grams of fresh and used (5000 mile) 5W30 GF4 motor oil at a concentration of 1 wt %. The individual additives were submitted for Cameron-Plint testing at 130 C and a load of 100N. Graphs in FIG. 2 (Cameron-Plint Data Concerning 1 WT % Friction Modifiers in Fresh 5W30 GF 4 Lubricant) and FIG. 3 (Cameron-Plint Data concerning 1 WT % Friction Modifiers in Used (5000 mile) 2W30GF Lubricant) details the boundary coefficient value from the examples.

TABLE IV

Friction Modifies Added to Fresh and Used 5W30 GF 4 Motor Oil.

| Example # | Friction Modifier Description | Additive Amount (wt %) |
|---|---|---|
| Exp FM 1 | 1 part alky amine/4 parts of ethylene oxide/8 parts of butylene oxide | 1 |
| Exp FM 2 | 1 part Alkyl amine/4 parts of ethylene oxide/4 parts of butylene oxide | 1 |
| Exp FM 3 | 1 part Alkyl amine/8 parts of ethylene oxide/2 parts of butylene oxide | 1 |
| Exp FM 4 | 1 part Alkyl amine/3 parts of ethylene oxide/1 part of butylene oxide | 1 |
| Exp FM 5 | 1 part Alkyl amine/2 parts of ethylene oxide/1 part of butylene oxide | 1 |
| Commerical FM 1 | 1 part Alkyl amine/2 parts of ethylene oxide | 1 |
| Commerical FM 2 | 1 part Oleyl amide/2 parts of ethylene oxide | 1 |
| Commerical FM 3 | 1 part Stearyl amide/2 parts of ethylene oxide | 1 |

Figure 2:
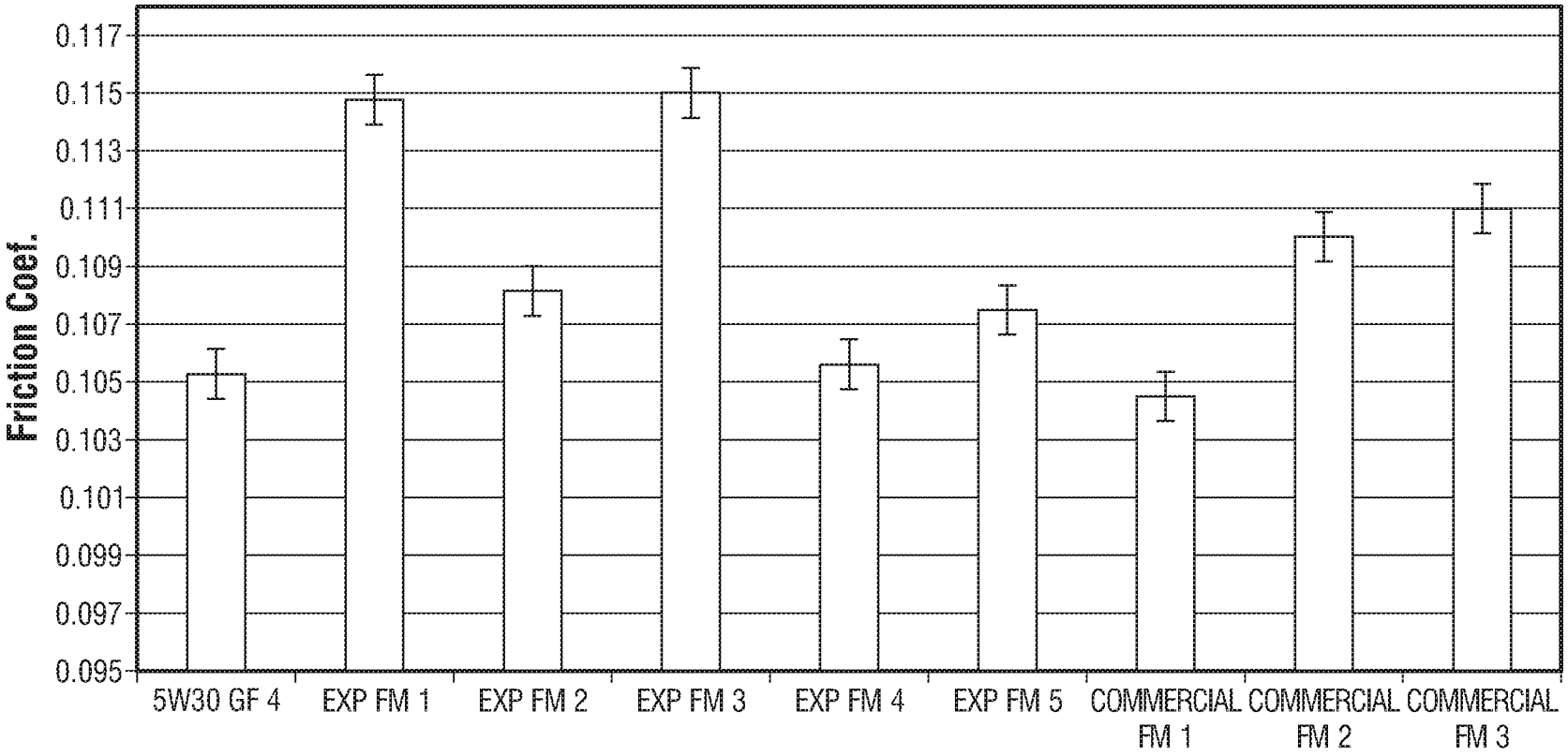
FIG. 2—This figure represents the Cameron-Plint (CP) generated friction coefficient value of fresh 5W30 GF4 motor oil as well as the fresh 5W30 GF 4 motor oil treated with the experimental and commercially friction modifiers from the Examples.
Figure 3:
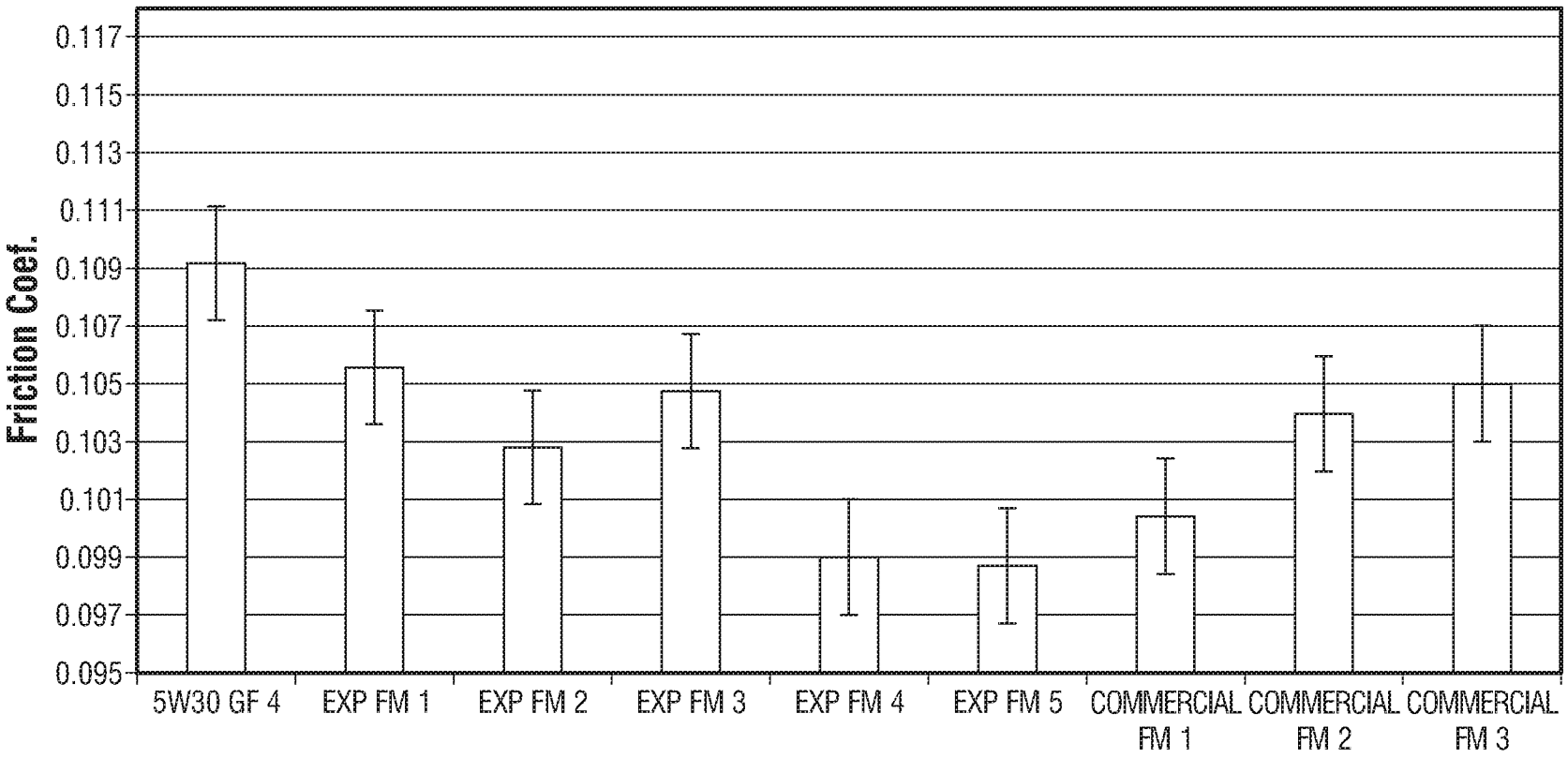
FIG. 3—This figure represents the Cameron-Plint (CP) generated friction coefficient value of used (5000-mile) 5W30 GF4 motor oil as well as the used (5000-mile) 5W30 GFR 4 motor oil with the experimental and commercially friction modifier from the Examples.

FIGS. 2 and 3 clearly demonstrate the responses of the various friction modifiers (experimental and commercial) in both fresh and used lubricant. In FIG. 2, only three (two experimental and one commercial) friction modifiers, which were 95% statistically equivalent to the lubricating ability of the 5W30 GF4 motor oil. However, there were five (three experimental and two commercial) friction modifiers, which increased the friction coefficient in all cases greater than 95% over the fresh lubricant.

However when the same experimental friction modifiers and commercial friction modifiers were added to the used 5,000-mile 5W30 GF4 lubricant a different response was noticed. Most of the friction modifiers (experimental and commercial) reduced the friction coefficient of the used lubricant, though not all at the same extent. The experimental friction modifiers Exp 4 and 5, which have the lowest amount of EO and BO, reduced the used lubricant friction coefficient the most, as compared to the other experimental friction modifiers as well as the commercial friction modifiers.

All friction modifiers outlined in Table V were added to 100 grams of fresh and used (5000 mile) 5W30 GF4 motor oil at a concentration of 1 wt %. The individual additives were evaluated using the minitraction machine (MTM) testing at 140 C and a load of 20 N. Graphs in FIGS. 4,5 and 6 details the boundary, mixed and hydrodynamic frictional regions from the experimental and commercial friction modifier M™ test in both fresh and used (5000 mile) 5W30 GF4 Lubricant.

TABLE V

Amount of Friction Modifies Added to Fresh and Used 5W30 GF 4 Motor Oil.

| Example # | Friction Modifier Description | Additive Amount (wt %) |
|---|---|---|
| Exp FM 1 | 1 part alky amine/4 parts of ethylene oxide/8 parts of butylene oxide | 1 |
| Exp FM 2 | 1 part Alkyl amine/4 parts of ethylene oxide/4 parts of butylene oxide | 1 |
| Exp FM 3 | 1 part Alkyl amine/8 parts of ethylene oxide/2 parts of butylene oxide | 1 |
| Exp FM 4 | 1 part Alkyl amine/3 parts of ethylene oxide/1 part of butylene oxide | 1 |
| Exp FM 5 | 1 part Alkyl amine/2 parts of ethylene oxide/1 part of butylene oxide | 1 |
| Commerical FM 1 | 1 part Alkyl amine/2 parts of ethylene oxide | 1 |

Figure 4:
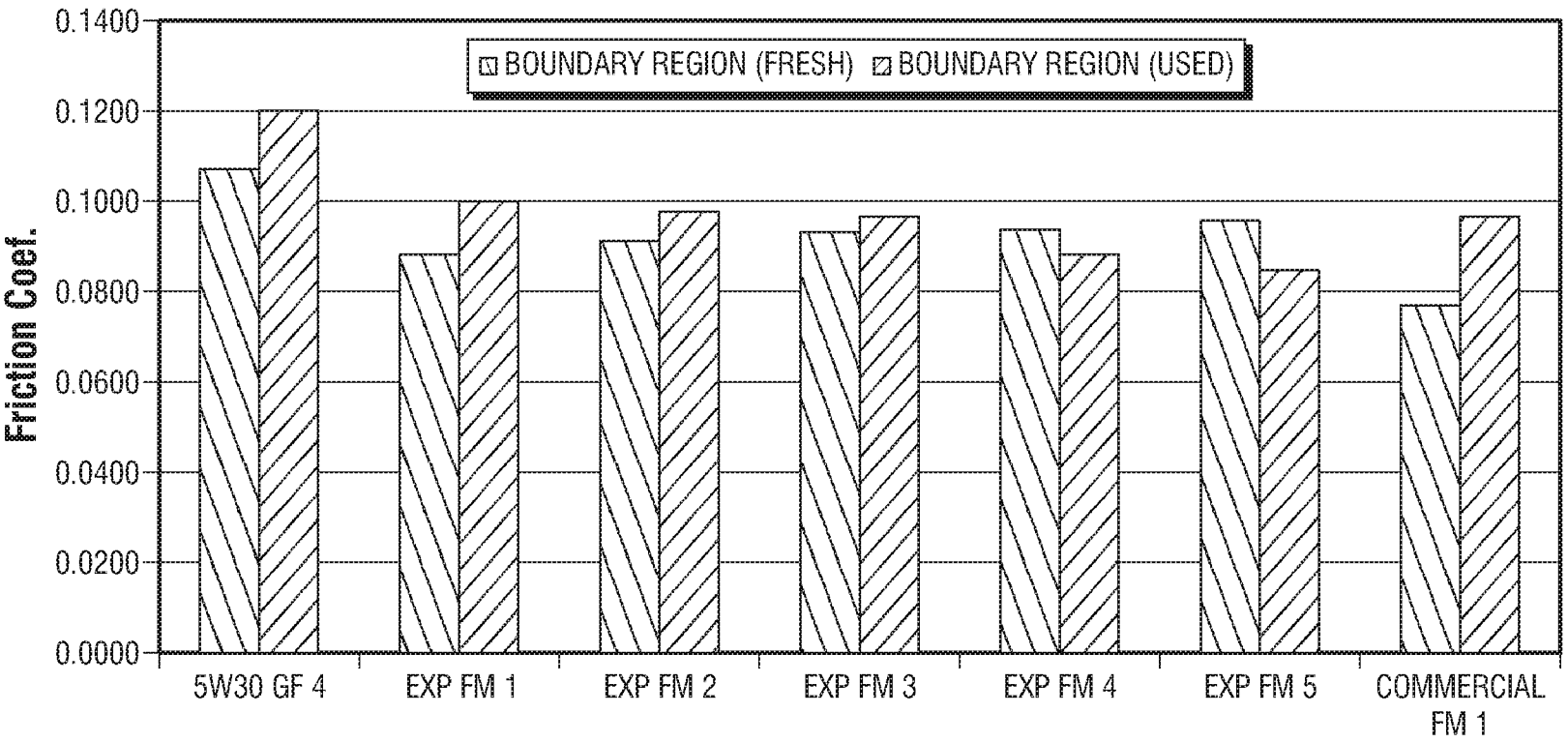
FIG. 4—This figure represents high frequency reciprocating rig (HFRR) wear scar in gasoline for base fuel and the five experimental friction modifiers and one of the commercially available friction modifiers from the Examples.
Figure 5:
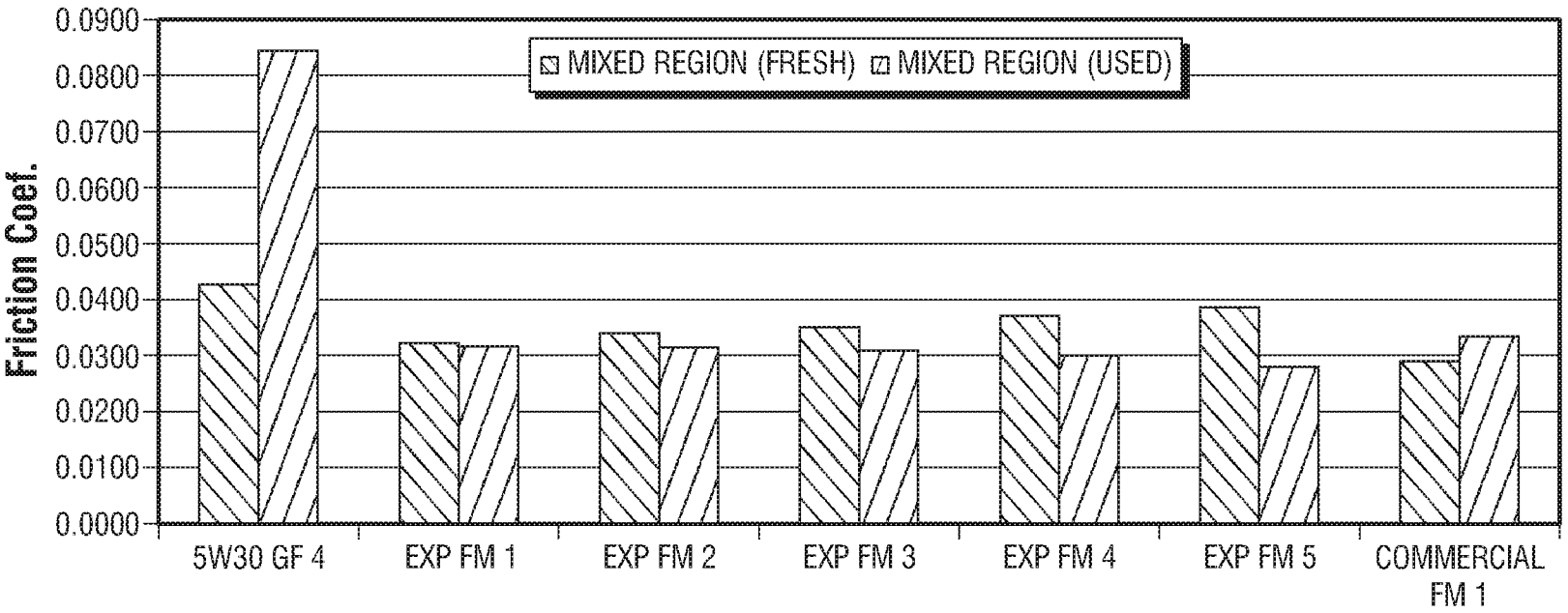
FIG. 5—This figure represents the mini-traction machine (MTM) friction coefficient value of fresh 5W30 GF 4 motor oil as well as the fresh 5W30 GF4 motor oil treated with the experimental friction modifiers and one commercially friction modifier from the Examples.
Figure 6:
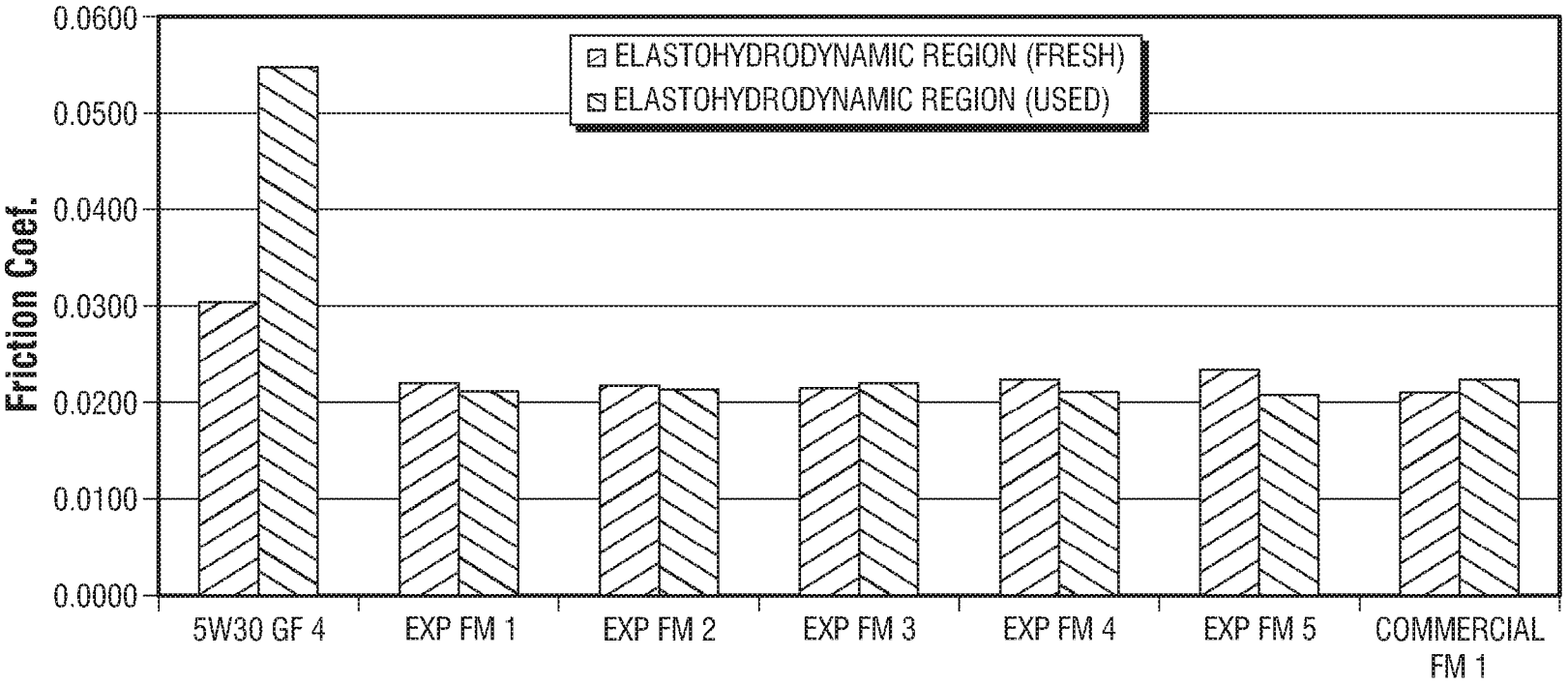
FIG. 6—This figure represents the mini-traction machine (MTM) friction coefficient value of used (5000 mile) 5W30 GF4 motor oil as well as the used (5000 mile) 5W30 GF4 motor oil treated with the experimental friction modifiers and one commercially available friction modifier from the Examples.

FIGS. 4-6 (MTM Boundary Region Friction Coefficient concerning Friction Modifiers in Fresh and Used (5000 mile) 5W30 GF4 (FIG. 4), MTM Mixed Region Friction Coefficient concerning Friction Modifiers in Fresh and Used (5,000 mile) 5W30 GF4 Lubricant (FIG. 5), MTM Elastohydrodynamic Region Friction Coefficient concerning Friction Modifiers in Fresh and Used (5000 mile) 5W30 GF4 Lubricant (FIG. 6)) clearly demonstrate a friction modifier can influence Boundary, Mixed and Elastohydrodynamic friction coefficient values of a lubricant though most of the frictional reduction takes place in the Boundary and Mix Region with a small reduction occurring in the Elastohydrodynamic Region. More importantly, Exp FM's 4 and 5 are two which clearly influence the three above mention regions the most and infact commercial FM 1 seem to work the best in the new lubricant though all FM's seem to work in the fresh lubricant.

Finally friction modifiers have a tendency to cause some emulsification between gasoline and water if water may be present. Therefore developing a friction modifier, which reduces friction but also shed water, would be advantageous.

Table V below shows the results from the ASTM D1094 water-shedding test conducted on the five experimental friction modifiers and one commercial friction modifier. After the initial mixing, the gasoline/water samples were observed for five minutes, one hour and then shaken again at the 24 hour point and re-evaluated. The sample rating was accomplished for the gasoline layer/water layer/and the gasoline/water layer interphase. The ratings used for this evaluation can be seen below and found in the ASTM D-1094 procedure.

| Rating | Appearance |
|---|---|
| | Gasoline/Water Layer |
| 1 | Complete absence of all emulsions and/or precipitates within either layer or upon the fuel layer. |
| 2 | Same as (1), except small air bubbles or small water droplets in the fuel layer. |
| 3 | Emulsions and/or precipitates within either layer or upon the fuel layer, and/or droplets in the water layer or adhering to the cylinder walls, excluding the walls above the fuel layer. |
| | Interphase |
| 1 | Clear and Clean |
| 1b | Clear bubbles covering not more than an estimated 50% of the interface and no shreds, lace, or film at the interface. |
| 2 | Shred, lace or film at interface |
| 3 | Loose lace or slight scum, or both |
| 4 | Tight lace or heavy scum or both |

It is clear from Table V that any of the experimental friction modifiers would be superior to water shedding than the commercial FM 1 additive in all three areas tested.

TABLE V

ASTM D1094 Friction Modifier Water Shedding Results

| | 5 Minutes | | | 1 Hour | | | 24 Hours | | |
|---|---|---|---|---|---|---|---|---|---|
| Samples | Fuel | Water | Interphase | Fuel | Water | Interphase | Fuel | Water | Interphase |
| Base Fuel | 1 | 1 | 1 | 1 | 1 | 1 | 1 | 1 | 1 |
| Exp FM 1 | 1 | 1 | 1 | na | na | na | 1 | 1 | 1 |
| Exp FM 2 | 1 | 1 | 1 | na | na | na | 1 | 1 | 1 |
| Exp FM 3 | 1 | 1-2 | 1-2 | 1 | 1-2 | 1-2 | 1 | 1-2 | 1-2 |
| Exp FM 4 | 1 | 1-2 | 2 | 1 | 1-2 | 2 | 1 | 1-2 | 2 |
| Exp FM 5 | 1 | 1-2 | 1-2 | 1 | 1-2 | 1-2 | 1 | 1-2 | 1-2 |
| Commercial FM 1 | 2 | 4 | 2-3 | 1-2 | 4 | 2-3 | 1-2 | 4 | 1-2 |
| 50/50 blend of Commerical FM 1/ Exp FM 1 | 1 | 1 | 1-2 | na | na | na | 1 | 1 | 1 |

I claim:

1. A composition comprising: (a) a major amount of a base oil and (b) a minor amount of at least one butylene oxide-modified alkyl-bis-ethoxylated monoamine, wherein the alkyl group have carbon atoms in the range of 8 to 22 and ethylene oxide to butylenes oxide is in a ratio in the range of about 3:1 to about 2:1 and nitrogen to ethylene oxide ratio in the range of 1:2 to 1:3.

2. The composition of claim 1 where in the butylene oxide-modified alkyl-bis-ethoxylated monoamine contains both a terminal ethylene oxide moiety and a butylene oxide moiety.

3. The composition of claim 1 wherein the alkyl group have carbon atoms in the range of 12 to 18.

4. The composition of claim 2 wherein the alkyl group have carbon atoms in the range of 12 to 18.

5. A lubricating oil composition comprising (a) a major amount of mineral and/or synthetic base oil and (b) a minor amount of at least one butylene oxide-modified alkyl-bis-ethoxylated monoamine, wherein the alkyl group have carbon atoms in the range of 8 to 22 and ethylene oxide to butylenes oxide is in a ratio in the range of about 3:1 to about 2:1 and nitrogen to ethylene oxide ratio in the range of 1:2 to 1:3.

6. The lubricating oil composition of claim 5 wherein the butylene oxide-modified alkyl-bis-ethoxylated monoamine have the following formula I:

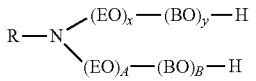

wherein EO is ethylene oxide moiety and BO is butylene oxide moiety, R is an alkyl group having 8 to 22 carbon atoms, A is an integer of 1 or higher, B is an integer of 1, X is an integer of 1 or higher, x+A is an integer of 2 or 3, and y is 0, which provides the butylene oxide-modified alkyl-bis-ethoxylated monoamine having an ethylene oxide to butylenes oxide ratio in the range of about 3:1 to about 2:1 and nitrogen to ethylene oxide ratio in the range of 1:2 to 1:3.

7. The lubricating oil composition of claim 6 wherein R is an alkyl group having 12 to 18 carbon atoms.

8. The lubricating oil composition of claim 5 wherein the butylene oxide-modified alkyl-bis-ethoxylated monoamine contains both a terminal ethylene oxide moiety and a butylene oxide moiety.

* * * * *